United States Patent [19]

Nobuo et al.

[11] 4,369,075

[45] Jan. 18, 1983

[54] METHOD OF MANUFACTURING PERMANENT MAGNET ALLOYS

[75] Inventors: Imaizumi Nobuo; Aoe Masahiro, both of Tokyo, Japan

[73] Assignee: Namiki Precision Jewel Co., Ltd., Tokyo, Japan

[21] Appl. No.: 220,023

[22] PCT Filed: Feb. 29, 1980

[86] PCT No.: PCT/JP80/00038

§ 371 Date: Dec. 18, 1980

§ 102(e) Date: Dec. 3, 1980

[87] PCT Pub. No.: WO80/02297

PCT Pub. Date: Oct. 30, 1980

[30] Foreign Application Priority Data

Apr. 18, 1979 [JP] Japan ..... 54-48333
Aug. 11, 1979 [JP] Japan ..... 54-102363

[51] Int. Cl.[3] ..... H01F 1/02

[52] U.S. Cl. ..... 148/102; 148/103; 148/104; 148/126.1; 419/25; 419/41; 419/57; 419/60

[58] Field of Search ..... 148/101, 102, 103, 104, 148/105, 108, 126; 75/211, 213, 214, 224, 225, 227

[56] References Cited

U.S. PATENT DOCUMENTS 3,560,200 2/1971 Nesbitt et al. ..... 148/102
3,982,971 9/1976 Yamanaka et al. ..... 148/102
4,047,982 9/1977 Sagawa et al. ..... 148/101
4,082,582 4/1978 Menth et al. ..... 148/102
4,116,726 9/1978 Menth et al. ..... 148/101
4,131,495 12/1978 Menth et al. ..... 148/101
4,135,953 1/1979 Nagel et al. ..... 148/105
4,210,471 7/1980 Yoneyama et al. ..... 148/102
4,213,802 7/1980 Rothwarf et al. ..... 148/101
4,213,803 7/1980 Yoneyama et al. ..... 148/102
4,221,613 9/1980 Imaizumi et al. ..... 148/126

*Primary Examiner*—John P. Sheehan
*Attorney, Agent, or Firm*—Gerald J. Ferguson, Jr.; Joseph J. Baker

[57] ABSTRACT

This invention relates to a process for manufacturing $R_2Co_{17}$ system permanent magnet alloys of rare earth(R)-cobalt(Co) intermetallic compounds. $Sm_2Co_{17}$ alloy, in which R is samarium (Sm) with respect to intermetallic compounds whose stoichiometric composition is $R_2Co_{17}$, possesses high saturation magnetization and high Curie temperature making it possible to obtain a high energy product. However, its permanent magnetization has not been practiced much at all because coercive force could not be obtained. This invention practices heat aging for 0.5–200 hours at 700°–800° C. in the heat treatment process of the sintered material of $R_2(Co,Fe,M)_{17}$ system (M is one or more than one elements of Ti, Cr, Mn, Ni, Cu, Zr, Nb, Hf, Ta, and W) and the coercive force is increased by carrying out this process in a magnetic field to achieve permanent magnetization.

9 Claims, 4 Drawing Figures

METHOD OF MANUFACTURING PERMANENT MAGNET ALLOYS

TECHNICAL FIELD

This invention relates to a method of manufacturing rare earth-cobalt permanent magnet alloys.

BACKGROUND TECHNOLOGY

Rare earth metals and cobalt form various intermetallic compounds. Among them, the intermetallic compounds, $RCo_5$, whose atomic ratio between rare earth metals (R) and cobalt (Co) is 1:5, exhibit extremely large magnetocrystalline anisotropy and have come to be used as permanent magnet alloy materials. In particular, an energy product of about 24 Mg.Oe, a several times over the conventional alnico or ferrite permanent magnets, is obtainable with a $SmCo_5$ permanent magnet in which R is samarium (Sm). $SmCo_5$ is already being commercially produced.

However, the desirable characteristics of a permanent magnet required in recent apparatus such as small rotary machines, small meters, detectors, etc., which utilizes air gap flux caused by a permanent magnet in a magnetic circuit, are a high residual magnetic flux density and a high energy product. Under such circumstances, the $Sm_2Co_{17}$ intermetallic compound attracted attention since it has a higher saturation magnetization, a higher energy product and higher Curie temperature than $SmCo_5$. In other words, the saturation magnetization of $Sm_2Co_{17}$ reaches 12 KG, whereby, in theory, an energy product of 36 MG.Oe is obtainable. However, coercive force is not obtainable with the $Sm_2Co_{17}$ permanent magnet, and it was necessary to drastically improve the coervice force of the intermetallic compound, $Sm_2Co_{17}$, in order to produce a permanent magnet.

A method to improve the coercive force by partial substitution of Co with Cu or Cu and Fe, etc. has been reported as a measure to improve the coercive force as disclosed in U.S. Pat. No. 3,560,200. Furthermore, it became possible to increase the residual flux density and coercive force and to improve the angularity of demagnetizing characteristic, enabling the achievement of permanent magnet alloys that reach 30 MG.Oe in energy product, $(BH)_{max}$. However, the composition having such a characteristic was not the stoichiometric composition whose R-Co ratio is 2:17, but it was obtained with an alloy having the intermediate composition between the $RCo_5$ phase and the $R_2Co_{17}$ phase. As mentioned above, a sufficient magnetic characteristic could not be obtained with $R_2Co_{17}$ whose permanent magnetization has been desirable because of the high magnetocrystalline anistropy saturation magnetization, and Curie temperature. Thus, it has not come to be commercially produced as a permanent magnet material. Furthermore, in order to develop it into a high performance magnet, the composition must truly be of the $R_2Co_{17}$ phase or constitutes mainly of a Co+$R_2Co_{17}$ compound having a greater Co component than in the $R_2Co_{17}$ phase, and it is necessary to partially substitute Co with Fe in order to obtain higher saturation magnetization. The U.S. Pat. No. 4,135,953 reports on permanent magnets produced by adding Cr, Mn, Ti, W, or Mo to $R_2(Co,Fe)_{17}$ composition, and alloys of the composition that gained coercive force by sintering the above molded products at 1110°-1180° C., followed by solid solution treatment and heat treatment at 400°-600° C., as well as their manufacturing processes. However, the above invention is a manufacturing process for a liquid phase sintered magnet in which a powder sintering additive with low melting point is mixed in.

The purpose of this invention is to present a manufacturing process for alloys, whose chief constituent is the $R(Co, Fe, M)_z$ system (where z is 8.3~9.0) stoichiometric composition of $R_2Co_{17}$ phase, by adding a heat treatment process, which is new for rare earth-cobalt magnets, in order to obtain a high coercive force.

DISCLOSURE OF THE INVENTION

This invention involves weighing of various elements for the alloy composition, $R(Co_{1-x-y}Fe_xM_y)_z$ (R is one or more than one elements of Y, Ce, Nd, Pr, Sm, Eu, and M.M.; and M consists of one or more than one elements of Ti, Cr, Mn, Ni, Cu, Zr, Nb, Hf, Ta, and W; where M.M. is misch metal; $0.02 \leqq x \leqq 0.5$, $0.01 \leqq y \leqq 0.3$, $8.3 \leqq z \leqq 9.0$), to obtain a prescribed composition, melting them in a high frequency induction furnace or an electric arc furnace in an inert atmosphere, and obtaining ingots in a water-quenched copper mold. This ingot is finely pulverized to particle diameters of 0.5-5 μm with a vibration mill or a jet mill. This is compression-molded (pressure of 1-10 t/cm$^2$) in a magnetic or non-magnetic field to obtain the green material. Next, the said molded mass is sintered at a temperature of 1100°-1250° C., followed by solid solution treatment to produce a sintered mass.

This invention presents the following heat aging process: the same objective can be achieved by reheating the material in the temperature range of 700°-800° C., or in the process of cooling to room temperature following sintering, by cooling slowly during the temperature range of 700°-800° C., or maintaining the temperature constant at 700°-800° C. before cooling to room temperature. The most effective heating time to provide heat aging at 700°-800° C. is 0.5-200 hours. In the case of heat aging at a temperature below 700° C., a sufficient increase in coercive force cannot be obtained, and the aging time is not effective either unless the heat treatment is more than 200 hours. Or, in the case of heat aging at a temperature about 800° C., it is above the eutectic temperature of the $R_2Co_{17}$ phase and the increase in coercive force, which is the objective of this invention, cannot be attained. Thus, the most effective aging temperature is in the range of 700°-800° C.

However, this heat aging process revealed that while it provides the increasing effect of coercive force, it also induces an effect to reduce the magnetic characteristic by reducing the saturation magnetization of the material in the case of protracted aging. This is believed to be due to the fact that in the case of $R_2Co_{17}$ compounds, the temperatures in the vicinity of 750° C. correspond to the eutectic temperature for these compounds, and reformation of crystals is accelerated during the protracted aging, at which time crystals develop in directions that mutually cancel the magnetic moments held by mutual crystals. Thus, in order to prevent a decrease in the magnetization during aging, the aging treatment was carried out while magnetically fixing the direction of the magnetic moments of the crystals. Then, it was confirmed that the initial saturation magnetization was maintained even after the protracted aging treatment, and in addition, the process contributed to an improvement in the angularity of the demagnetization curve.

As for the method of magnetic fixation, the object of this invention can be achieved usually by carrying out the aging process while impressing a magnetic field from the outside of the heating furnace with an electromagnet, etc., or by carrying out the aging process while having the heated part in contact with or positioned nearby a magnet (e.g. alnico magnet) that can hold magnetism even in the temperature range of 700°-800° C. The objective of this invention can also be achieved by applying the fact that the Curie temperature of $R_2Co_{17}$ compounds is above 800° C. and carrying out the aging process in the magnetized state by magnetizing the sintered mass once prior to the aging process. In this case, there is an effect to interfere with the decrease in magnetization by preventing the antiparallel coupling of the magnetocrystalline moment produced during the aging process by the intrinsic magnetic field held by the magnet. Also, it is necessary in the case of anisotropic magnets that the direction of the external magnetic field match the direction of orientation of the magnet. The strength of the magnetic field required for achieving the objective of this invention should be at least 1 KOe. The coercivity at 700°-800° C., in the case of $R_2T_{17}$ compounds, is known to decrease down to 10-30% of the coercivity at room temperature. Thus, the above value can be determined based on the fact that the alloys having the composition that includes this invention possess a coercive force of 5-10 KOe at room temperature state. However, the objective of this invention is achieved even at a strength of the magnetic field below 1 KOe, but it is insufficient to completely prevent a decrease in saturation magnetization.

As a result, the addition of the aging heat process of this invention has effects of not only improving the coercive force, but enabling an improvement of the angularity of the demagnetization curve with respect to alloys related to this invention, whose chief constituent is a $R_2Co_{17}$ intermetallic compound with which coercive force has been unobtainable inspite of the high saturation magnetization present. In regard to raw material cost, a magnetic alloy having a lower content of expensive rare earth components can be used, and a decrease in the expensive cobalt (Co) component is promoted by increasing the iron (Fe) component, thus having the effect of supplying an alloy with inexpensive materials compared with conventional alloys.

BRIEF EXPLANATION OF THE DIAGRAMS

Figure 3:
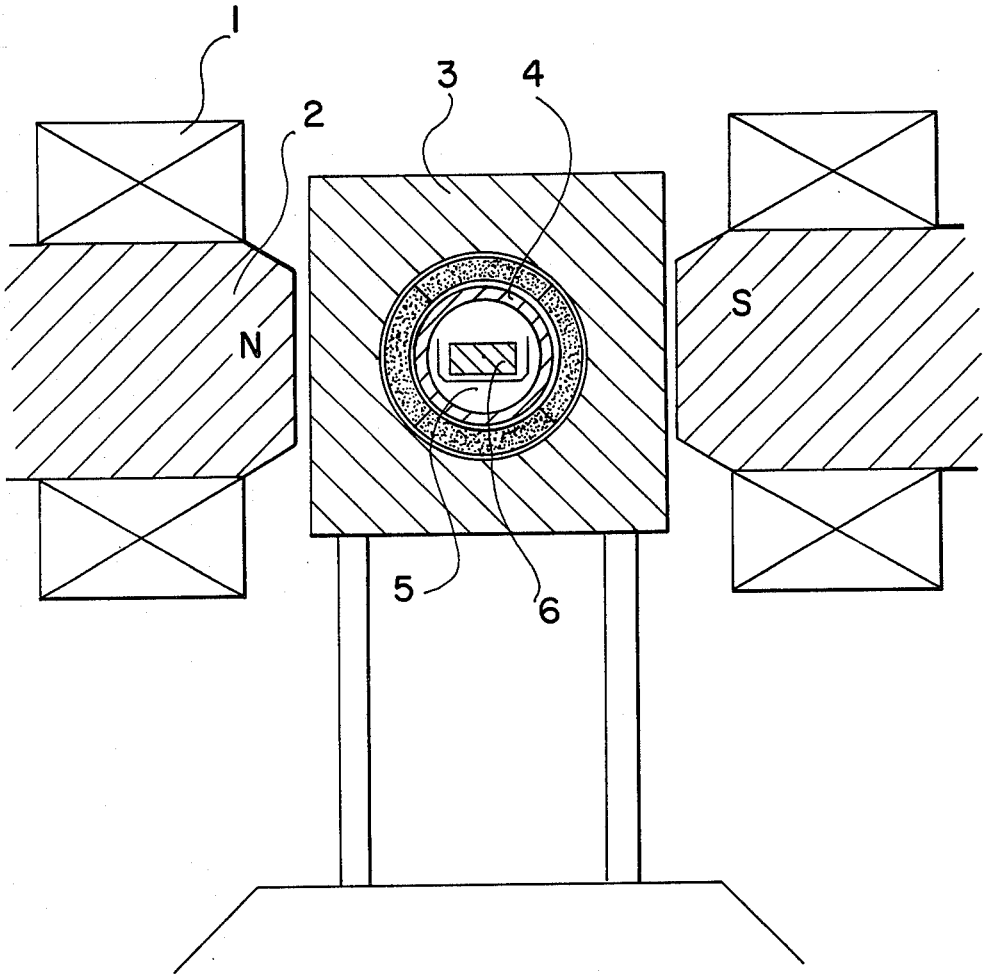
FIG. 3 is a cross-sectional diagram showing an example of an apparatus for aging process in a magnetic field.
Figure 4:
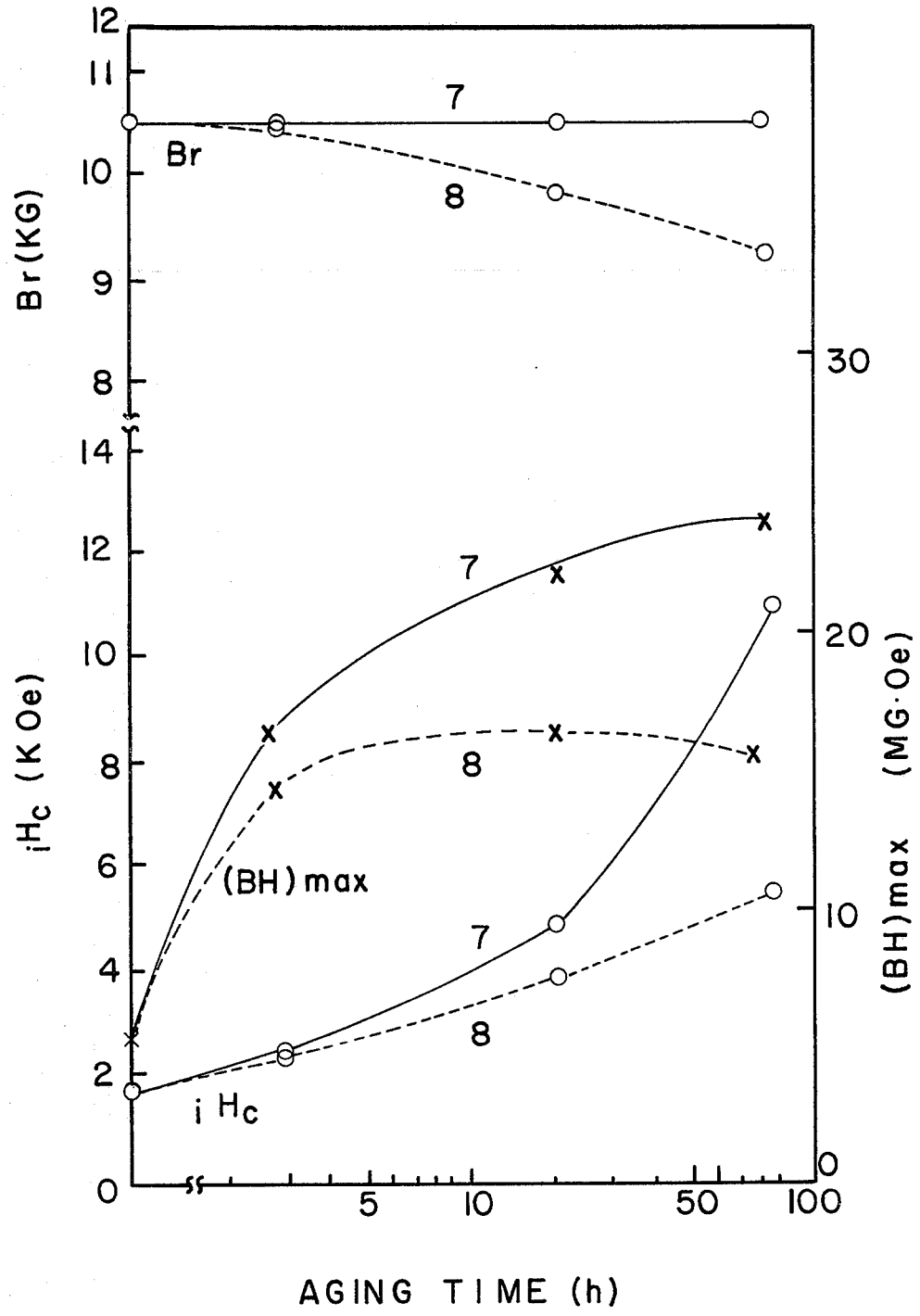

FIG. 4 is a graph showing the magnetic characteristic of a sample following aging process in a magnetic field at 750° C. for up to 75 hours in comparison with that of a sample following aging process is a non-magnetic field under the same conditions. In FIG. 3, the numbers designate the parts of the apparatus as follows: 1, coil; 2, magnetic pole; 3, adiabatic material and heater; 4, core pipe; 5, product container; 6, magnetic material. In FIG. 4; the numbers are to be understood as follows 7, aging in magnetic field; 8, aging in non-magnetic field.

OPTIMUM FORMS TO CARRY OUT THE INVENTION

Next, the optimum forms to carry out this invention are described by citing specific practical examples.

Figure 1:
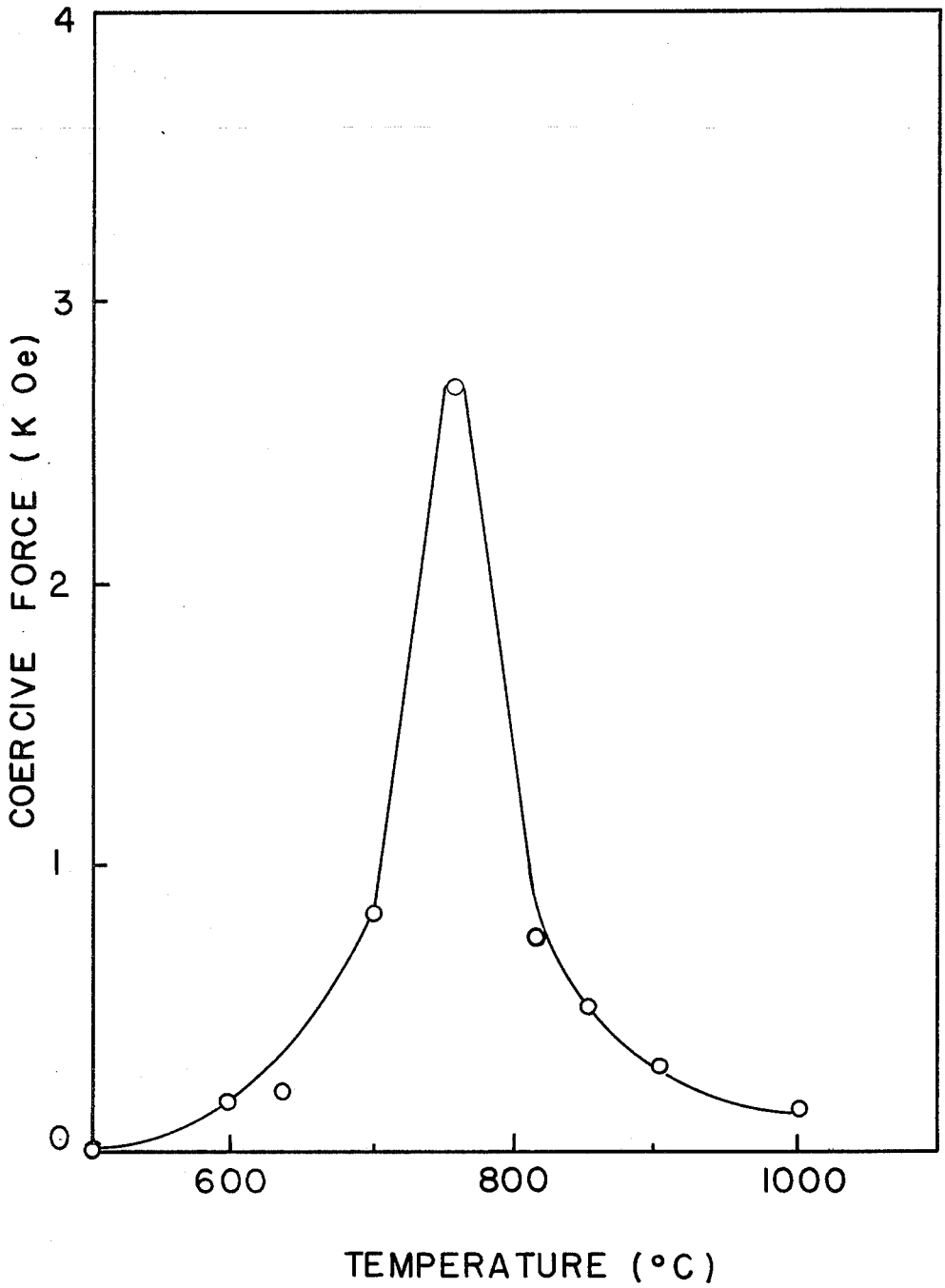
FIG. 1 is a graph showing changes in coercive force after heat aging of a sintered alloy having the composition of $Sm(Co_{0.72}Fe_{0.15}Cu_{0.1}Zr_{0.03})_{8.7}$ at various temperatures.

Practical example 1. Component elements were weighed to make the composition of $Sm(Co_{0.72}Fe_{0.15}Cu_{0.1}Zr_{0.03})_{8.7}$, melted with arc in Ar atmosphere, and water-quenched to obtain an ingot in a copper mold. Then, the ingot was first roughly pulverized, then made into fine particles of 3 μm in average grain size with a vibration mill. This powder was oriented in a 10 KOe magnetic field and compression-molded under the pressure of approx. 5 t/cm$^2$ to obtain green material. After the green material was vacuum-exhausted (about $10^{-3}$ Torr), it was sintered by heating for 2 hours at 1180° C., furnace-cooled to room temperature, and used as a sample for aging tests. In order to examine the state of aging, this sample was heated for one hour at various temperatures ranging 500°-1000° C., and the coercive force upon furnace-cooling to room temperature was measured. The results obtained are shown in FIG. 1. It is evident from the graph that heat aging carried out in the temperature range of 700°-800° C. is effective in improving the coercive force.

Figure 2:
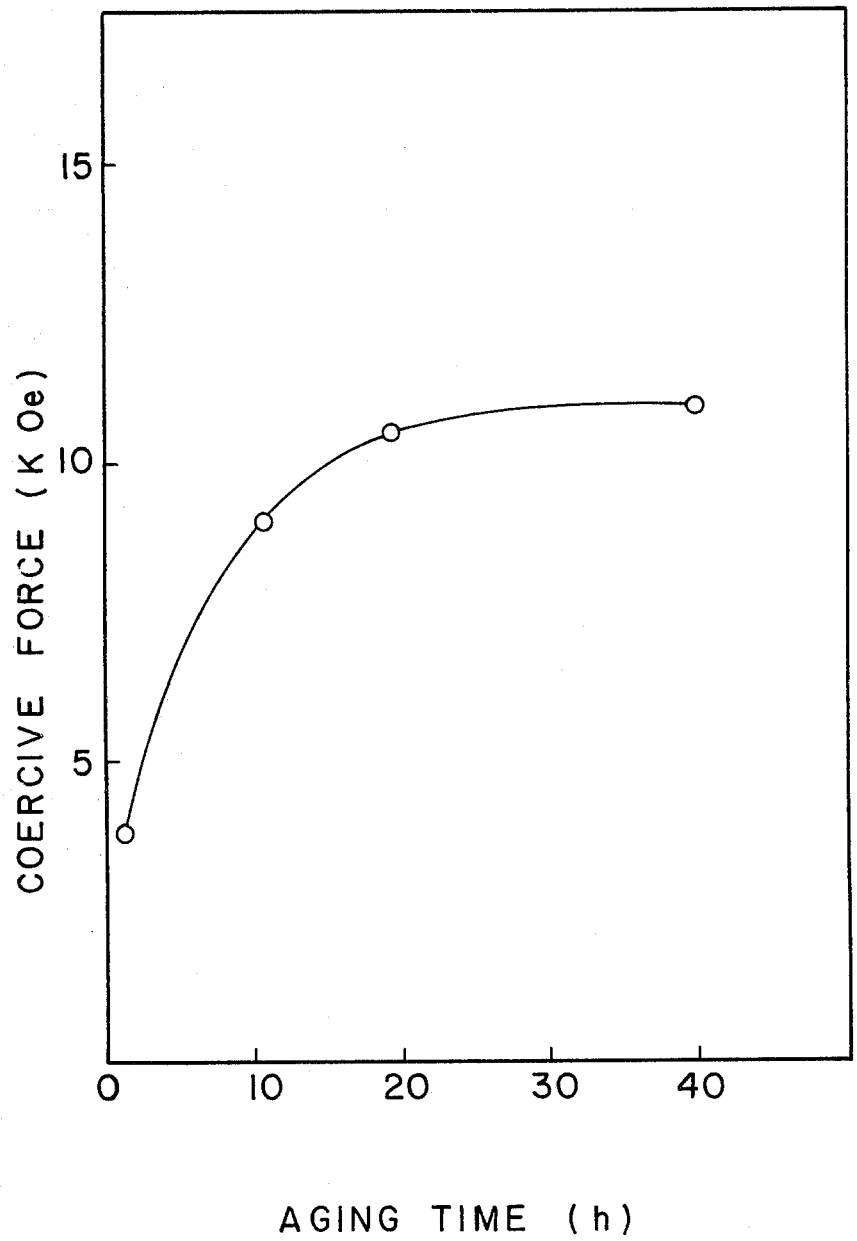
FIG. 2 is a graph showing the changes in coercive force with respect to aging time when a sintered alloy having a composition of $Sm_{0.8}Y_{0.2}(Co_{0.77}Fe_{0.10}Cu_{0.13})_{8.8}$ is heat-aged at 750° C.

Practical example 2. Green material was obtained in the same manner as in practical example 1 from an ingot with the composition of $Sm_{0.8}Y_{0.2}(Co_{0.77}Fe_{0.10}Cu_{0.13})_{8.8}$. Next, after sintering for one hour at 1200° C. in vacuum, the material was furnace-cooled to room temperature and, in order to examine the state of aging, it was reheated to 750° C. for preparing samples with varied heating time. The relationship between the heating time and coercive force was studied by measuring the coercive force of these samples, and the result shown in FIG. 2 was obtained. It is clear from the graph that the coercive force increases from 0.5 hr. showing state of saturation after 20 hrs and becoming constant.

Practical example 3. Ingots having the composition of $Sm_{0.7}Y_{0.3}(Co_{0.67}Fe_{0.20}Cu_{0.10}Hf_{0.03})_z$ where z=8.3, 8.5, 8.7, and 8.9, were prepared in the same manner as in practicle example 1. Next, the ingots were finely pulverized to average granular diameter of 2 μm with a vibration mill, oriented in a magnetic field and compression-molded to form green materials. In coercive force of these materials after sintering for 2 hours at 1170° C. and furnace-cooling, and changes in the coercive force following reheating them for 20 hours at 750° C. were studied (Table 1). In the case of aging heat of 750° C. from the outside, the highest coercive force was obtained in the neighborhood of z=8.7.

TABLE 1

| z | Coercive force after sintering (Oe) | Coercive force after aging for 20 hrs at 750° C. (Oe) |
|---|---|---|
| 8.3 | 840 | 950 |
| 8.5 | 300 | 950 |
| 8.7 | 200 | 2200 |
| 8.9 | 150 | 1050 |

Practical example 4. Green material was obtained from an ingot having the composition of $Sm(Co_{0.77}Fe_{0.11}Cu_{0.12}Zr_{0.01})_{8.8}$ in the same manner as in practical example 1. This was sintered in vacuum for one hour at 1200° C., furnace-cooled to 750° C., soaked for 2 hours at 750° C., and furnace-cooled to room temperature.

Magnetic characteristic of this sample was measured and following results were obtained.

$B_r = 10.1$ KG ${}_iH_c = 4.45$ KOe $(BH)_{max} = 18.0$ MG.Oe

Practical example 5. Green material was obtained from an ingot having the composition of $Sm_{0.7}Y_{0.3}(Co_{0.73}Fe_{0.16}Cu_{0.08}Zr_{0.03})_{8.6}$ in the same manner as in practical example 1. The green material was vacuum-exhausted (about $10^{-3}$ Torr) and sintered by heating for one hour at 1190° C., furnace-cooled to room temperature, and used as a sample for aging tests in a magnetic field. Part of this sample was magnetized: the sample was positioned in an electric furnace which was placed between the poles of electromagnets (FIG. 3) such that the direction of the orientation match the direction of the magnetic field generated between the magnetic poles (2), and aging process was carried out while energizing the electromagnets. On the other hand, the remaining sample was not magnetized and aging process was practiced in a non-magnetic field, and the two samples were compared. FIG. 4 shows the results. In the case of the sample on which protracted aging process was carried out at 750° C. without impressing a magnetic field as in a conventional process, although the coercive force (${}_iH_c$) has increased, the residual magnetic flux density ($B_r$) decreased by about 2 KG (following a 75-hr. treatment at 750° C.) showing a drastic decrease in the magnetic characteristic. However, in the case of the sample on which aging process was carried out while impressing a magnetic field of about 5 KOe from electromagnets based on this invention, the decrease in $B_r$ did not occur, but the coercive force improved as the aging time increased, thus proving a drastic improvement in the energy product, $(BH)_{max}$.

We claim:

1. A process for manufacturing permanent magnet alloys characterized by the fact that an alloy of $R(Co_{1-x-y}Fe_xM_y)_z$ (R is one or more than one elements of Y, Ce, Nd, Pr, Sm, Eu, and M.M.; and M consists of one or more than one elements of Ti, Cr, Mn, Ni, Cu, Zr, Nb, Hf, Ta, and W; where M.M. is misch metal; $0.02 \leqq x \leqq 0.5$, $0.01 \leqq y \leqq 0.3$, $8.3 \leqq z \leqq 9.0$) is finely powdered and compression-molded in a magnetic field or without impressing a magnetic field; and the molded powder is sintered at a temperature of 1100°–1250° C. in vacuum or in an inert atmosphere; solid solution treated and, heat aged for 0.5–200 hours in the temperature range of 700°–800° C. in a further magnetic field.

2. A process for manufacturing permanent magnet alloys as in claim 1, where said further magnetic field is more than 0.5 Koe.

3. A process for manufacturing permanent magnet alloys as in claims 1 or 2 where the direction of said further magnetic field matches the direction of orientation of the permanent magnet alloy in the case of an anisotropic permanent magnet alloy.

4. A process for manufacturing permanent magnet alloys as in claim 1 where the solution treated, molded powder is cooled to room temperature after the sintering and solid solution treatment and heat aged by reheating for 0.5–200 hours in the temperature range of 700°–800° C.

5. A process for manufacturing permanent magnet alloys as in claim 1 where the solution treated, molded powder is cooled to room temperature after heat aging by gradual cooling for 0.5–200 hours in the temperature range of 700°–800° C. during the cooling process to room temperature, after the sintering and solid solution treatment.

6. A process for manufacturing permanent magnet alloys as in claim 1 where the solution treated, molded powder is cooled to room temperature after heat aging by soaking it for 0.5–200 hours at a constant temperature in the range of 700°–800° C. during the cooling process to room temperature, after the sintering and solid solution treatment.

7. A process as in claim 1, where the finely powdered alloy has particle diameters of 0.5–5 μm.

8. A process as in claim 2 wherein said further magnetic field is at least 1 KOe.

9. A process as in claim 4 where the alloy has the composition $Sm_{0.7}Y_{0.3}(Co_{0.73}Fe_{0.16}Cu_{0.08}Zr_{0.03})_{8.6}$, and said further magnetic field is about 5 KOe.

* * * * *